United States Patent [19]

Payet et al.

[11] Patent Number: 4,875,901

[45] Date of Patent: Oct. 24, 1989

[54] TREATING FIBROUS POLYAMIDE ARTICLES

[75] Inventors: George L. Payet, St. Paul; John C. Chang, New Brighton, both of Minn.

[73] Assignee: Minnesota Mining and Manufacturing Company, Saint Paul, Minn.

[21] Appl. No.: 314,234

[22] Filed: Feb. 21, 1989

Related U.S. Application Data

[63] Continuation of Ser. No. 201,381, Jun. 1, 1988, abandoned, which is a continuation of Ser. No. 918,376, Oct. 14, 1986, abandoned.

[51] Int. Cl.[4] ..... D06M 3/30; B32B 3/02

[52] U.S. Cl. ..... 8/115.56; 8/115.68; 428/96; 524/436; 524/841

[58] Field of Search ..... 8/115.56, 115.68; 428/96; 524/436, 841

[56] References Cited

U.S. PATENT DOCUMENTS 4,325,890 4/1982 Reitz et al. ..... 260/512 C

FOREIGN PATENT DOCUMENTS 0073606 3/1983 European Pat. Off. .

*Primary Examiner*—Paul Lieberman
*Assistant Examiner*—John F. McNally
*Attorney, Agent, or Firm*—D. M. Sell; W. N. Kirn; C. Truesdale

[57] ABSTRACT

A method for providing fibrous polyamide materials with stain resistance is provided. The method comprises contacting the fibrous polyamide materials with an aqueous solution comprising a normally solid, water-soluble, partially sulfonated novolak resin, which comprises the condensation product of at least one phenolic compound and an aldehyde, and a water-soluble divalent metal salt.

19 Claims, No Drawings

TREATING FIBROUS POLYAMIDE ARTICLES

This is a continuation of application Ser. No. 201,381 filed June 1, 1988.

The present invention relates to a process for providing stain resistance to polyamide articles, such as nylon and wool carpets, nylon, wool, and silk fabrics, and natural and synthetic leathers.

Fibrous polyamide articles such as nylon and wool carpets, nylon, wool, and silk fabric, natural leather, and synthetic leathers such as Ultrasuede TM are particularly susceptible to staining by natural and artificial acid colorants such as are commonly found in many foods and beverages. A need has long been felt for processes for economically providing such fibrous polyamide articles with resistance to staining by acid colorants. Particularly desirable are processes by which stain resistance can be imparted to fibrous polyamide articles during conventional processing and treating operations.

U.S. Pat. No. 4,501,591 (Ucci et al.) discloses a process for providing stain-resistant polyamide carpets in which a sulfonated phenol-formaldehyde condensation product and an alkali metal silicate are added to the dye liquor in a continuous dyeing process, followed by steaming, washing, and drying the carpet.

U.S. Pat. No. 4,592,940 (Blyth et al.) discloses a process for imparting stain resistance to nylon carpet by immersing the carpet in a boiling aqueous solution of a selected phenol-formaldehyde condensation product at a pH of 4.5 or less. The process is carried out in conventional beck dyeing apparatus subsequent to dyeing (generally at a pH of 6.5 to 8.0) by either acidifying the bath to pH 4.5 or less or draining the dye bath and then replacing the dye bath with a corresponding amount of water adjusted to pH 4.5 or less. Blyth et al. disclose that insufficient condensation product for imparting stain resistance is picked up by the carpet at pH greater than 4.5 and temperature less than 95° C.

U.S. Pat. No. 4,579,762 (Ucci) discloses stain-resistant nylon carpet in which the nylon fibers are made from polymer modified to contain, as an integral part of its polymer chain, sufficient aromatic sulfonate units to improve the acid dye resistance of the fibers and in which the backing adhesive contains a fluorochemical in an amount sufficient to render the backing a barrier to liquids.

Japanese Examined Patent Application (Kokoku) No. 48-8789 (1973) (Meisei) discloses a method for treatment of dyed polyamide fibers to improve antistatic and anti-melting properties and moisture resistance in which a ligand oligomer, formed from sulfonated 4,4'-dihydroxy-diphenyl sulfone-formaldehyde condensate with a metal compound prepared from citric acid and a metal chloride, metal oxide, or organic metal salt, is applied to fiber from a treatment bath or, alternatively, the sulfonated 4,4'-dihydroxy-diphenyl sulfone-formaldehyde condensate and a metal compound prepared from a metal salt, citric acid and hydroxy acetic acid, are added to the treatment bath separately.

U.S. Pat. No. 4,329,391 (McAlister) discloses the treatment of synthetic fibers with a sulfonated polyester stain-releasing finish in an aqueous bath which includes the addition of water-soluble salts to the aqueous fabric treating bath. The treatment provides a finish which enhances oily soil release during after-stain laundering.

U.S. Defensive Publication T949,001 (Pacifici) discloses a process for improving the durability of water-dispersible polyester and polyester amide textile finishes on fabric where the fabric, after application of the finish, is treated with an aqueous solution of polyvalent metal salts.

U.S. Pat. No. 3,322,488 (Feeman) discloses sulfomethylated condensation products of bisphenols and aldehydes for use in reserving synthetic polyamide and polyurethane fibers to render them resistant to acid and direct dyes.

U.S. Pat. No. 3,663,157 (Gilgien et al.) discloses a process for printing nylon fabric with disperse or monosulfonated acid dyes wherein the fabric is pretreated with an aqueous solution of a fiber-substantive, water-soluble, anionic resist which is a polycondensate of a diarylsulfone containing at least one phenolic hydroxy group with formaldehyde.

U.S. Pat. No. 3,926,548 (Moriyama et al.) discloses aminated hydrophobic fibers having a surface resistant to anionic dyes, the surface of the fibers having been treated with a compound having groups capable of linking to amino groups in the fibers to form covalent bonds. Such groups include halotriazinyl, halopyrimidinyl, haloquinoxalyl, haloacrylamido, vinylsulfo groups, etc., or any other groups that can produce these groups. Also suitable are compounds having anionic groups, for example, sulfonate, carboxylate, sulfate, phosphate groups, etc., besides the highly reactive groups capable of reacting with amino groups.

U.S. Pat. No. 3,959,559 (Kimoto et al.) discloses a process for producing modified synthetic fibers in which the fibers are treated with a reaction product of a specified s-triazine or piperazine derivative, with a specified derivative of polyoxyethylene and further adhering onto the resulting fibers a specified aromatic sulfonic acid. The modified fibers resist contamination from liberated dyestuff or ionic contaminants during laundering or dry cleaning.

U.S. Pat. No. 4,322,512 (Lenox) discloses treating a polyamide textile material with a substituted trimellitic anhydride compound, the treatment decreasing the textile material's affinity for acid dyes.

U.S. Pat. No. 4,343,923 (Lenox et al.) discloses a method for decreasing a textile material's affinity for acid dyes in which the textile material is pretreated with an acylimidazole compound.

Brownewell, Ralph G., "Two New Chemicals Create Better Multicolored Nylons," *American Dyestuff Reporter,* Vol. 68, No. 3, 1979, pp 38–41, discloses processes for providing nylon fabrics which are resistant to coloration by acid dyes by treatment with Sandospace S, a product of Sandoz Colors and Chemicals, believed to be a benzenoid triazine derivative.

U.S. Pat. No. 4,563,190 (Topfl) discloses a dyeing assistant useful in the dyeing of polyamide fibers with acid dyes. The dyeing assistant is a mixture of (A) a sulfonated condensation product of hydroxyaryl compounds and formaldehyde or a sulfonated N-aryl-melamine derivative, and (B) a specified quaternary ammonium, and, optionally, (C) a siloxane/oxyalkylene copolymer and (D) a polar solvent.

European Patent Appln. No. 83,303,341.8 discloses increased exhaustion of fluorochemical treating agents for providing oil and water repellency by the addition of salt compounds such as sodium sulfate and citrate, magnesium chloride, ammonium sulfate and chloride, aluminum sulfate, calcium chloride, and potassium chloride.

U.S. Pat. No. 4,013,627 (Temple) discloses a fluorochemical polymer for treating fabrics to provide oil and water repellency, the polymer being derived from fluorochemical acrylate monomer, a vinyl monomer free of non-vinylic fluorine, and a vinyl monomer which contains an onium ionic group. Salts, such as alkali metal sulfates and low molecular weight alkylamine hydrochlorides, may be added, as adjuvants, to textile treating baths containing the fluorochemical polymer to aid deposition of the polymer onto the fabric being treated.

European Patent Application No. 0.016,658 (Monsanto) discloses soil-resistant carpet yarns prepared by coating the yarn with a soil retardant agent such as a fluorochemical and a retaining agent such as zirconium oxide.

The present invention provides a method for providing fibrous polyamide material with stain resistance to natural and artificial acid colorants comprising contacting the fibrous polyamide material with an aqueous solution comprising a normally solid, water-soluble, partially sulfonated novolak resin, which comprises the condensation product of at least one phenolic compound and an aldehyde such as, for example, formaldehyde or acetaldehyde, and a water-soluble divalent metal salt. The resin and salt are applied in sufficient amounts and for sufficient time at a given temperature to provide stain resistance. The combination of the sulfonated novolak resin and divalent metal salt provides surprising effective stain resistance using reduced amounts of the resin and permits application over a wide pH range.

The method of this invention can be carried out in three different ways. One method comprises the steps of (Ia) adding to a dyebath, before, during, or after dyeing of the fibrous polyamide material, such as in a dye beck with nylon carpet, at least 0.1% solids based on the weight of the fabric (owf) of the sulfonated novolak resin and at least 1% owf of the divalent metal salt, (Ib) immersing the polyamide material in the dyebath for a time and temperature sufficient to exhaust the sulfonated novolak resin onto the polyamide material, (Ic) removing the treated polyamide material from the dyebath, and (Id) drying the removed polyamide material.

A second method comprises the steps of (IIa) applying to the polyamide material an aqueous solution comprising at least 0.1% solids owf of the sulfonated novolak resin and at least 1% owf of the divalent metal salt, such as during continuous dyeing of nylon carpet using Kuster TM or Otting TM continuous dyeing equipment, (IIb) steaming the treated polyamide material for a time sufficient to effect adherence of the sulfonated novolak resin to the polyamide material, and (IIc) drying the polyamide material.

A third method comprises the steps of (IIIa) padding an aqueous solution comprising at least 0.1% owf of the sulfonated novolak resin and at least 1% owf of the divalent metal salt onto the polyamide material and (IIIb) drying the polyamide material.

The invention further provides including a fluorochemical composition in the aqueous solution comprising the sulfonated novolak resin and the divalent salt in step Ia, IIa, or IIIa to provide the polyamide material with oil and water repellency. The invention further provides an aqueous solution useful in providing stain resistance to fibrous polyamide material comprising the water-soluble partially sulfonated novolak resin and the water-soluble divalent salt. The invention also provides fibrous polyamide materials such as nylon, silk, and wool fabrics, yarns, and fibers, nylon and wool carpets, and natural and synthetic leather such as Ultrasuede TM with stain resistance by treating the polyamide materials as described in method I, II, or III hereinabove.

The present invention still further provides fibrous polyamide materials with stain resistance and oil and water repellency by treating the polyamide material, as described in method I, II, or III hereinabove, with a fluorochemical composition added to the treating solution.

The sulfonated novolak resins useful in this invention include known substances such as those compositions which are condensation products of formaldehyde with bis(hydroxyphenyl)sulfone and phenylsulfonic acid. Instead of, or in addition to, formaldehyde, another aldehyde such as, for example, acetaldehyde, furfuraldehyde, or benzaldehyde, can be used to make the condensation product. Also, other phenolic compounds such as, for example, bis(hydroxyphenyl)alkane, e.g., 2,2-bis(hydroxyphenyl)propane, and bis(hydroxyphenyl) ether compounds can be used instead of, or in addition to the bis(hydroxyphenyl)sulfone. The sulfonated novolak resin is partially sulfonated, i.e., has a sulfonic acid equivalent weight of about 300–1200, preferably 400–900. Examples of such resins are disclosed in U.S. Pat. No. 4,592,940 (Blyth et al.) which is incorporated herein by reference for this purpose. Also commercially available sulfonated novolak products are available such as Intratex TM N, available from Crompton and Knowles Corp., and Erional TM PA, available from Ciba-Geigy Corp., Nylofixan TM P available from Sandoz Ltd. Mesitol TM NBS, available from Mobay Chemical Corp., Resist #4, available from Lyndal Chemical Co., Ameriolate TM, available from American Emulsions Co. Inc. and Synthabond TM 1938 available from Piedmont Chemical Industries. Sulfonation of phenolic compounds is taught, for example, in Sulfonated and Related Reactions, E. E. Gilbert, Interscience Publishers, (1965). Condensation of phenol-formaldehyde resins is taught, for example, in Phenolic Resins, A. Knop et al., Springer-Verlag, (1985).

The divalent metal salts useful in the present invention include water soluble inorganic and organic salts of metals such as magnesium, barium, calcium, and zinc. Inorganic metal salts include chlorides, sulfates, and nitrates of these metals. Organic metal salts include acetates and formates of these metals. Preferred divalent metal salts are magnesium sulfate, magnesium chloride and magnesium acetate. Mixtures of two or more salts can also be used in this invention. Generally, when both the sulfonated novolak resin and fluorochemical compositions are in the aqueous treating solution, magnesium salts are preferably used to achieve both stain resistance and oil and water repellency.

The fluorochemical compositions useful in the present invention for providing oil and water repellency include anionic, cationic, or nonionic fluorochemicals such as the fluorochemical allophanates disclosed in U.S. Pat. No. 4,606,737 (Stern); fluorochemical polyacrylates disclosed in U.S. Pat. Nos. 3,574,791 (Sherman et al.) and 4,147,851 (Raynolds); fluorochemical urethanes disclosed in U.S. Pat. No. 3,398,182 (Guenthner et al.); fluorochemical carbodiimides disclosed in U.S.

Pat. No. 4.024,178 (Landucci); fluorochemical guanidines disclosed in U.S. Pat. No. 4,540,497 (Chang et al.).

The sulfonated novolak resins are preferably used in an amount of at least 0.1% solids owf, more preferably 0.15% owf, most preferably at least 0.35% owf. Amounts in excess of 3% owf generally do not provide any appreciable increase in stain resistance. The amount of sulfonated novolak resin required to provide adequate stain resistance depends on the fibrous polyamide material being treated. For example, nylon 6 and wool generally require larger amounts of the resin than nylon 66. When the polyamide material is heat-set carpet yarn, yarn heat-set under moist conditions, e.g., in an autoclave, generally requires larger amounts of the resin than with yarn heat-set under substantially dry conditions.

The divalent metal salts are preferably used in an amount of at least 1% owf, more preferably at least 1.5% solids owf, most preferably at least 2% solids. Amounts of the salt in excess of 5% owf generally do not provide any appreciable increase in stain resistance.

The fluorochemical composition, when included in the treating solution, is preferably present in an amount of at least about 0.15% solids owf, more preferably at least 0.2% solids owf, most preferably 0.35% owf. Generally, amounts of the fluorochemical composition in excess of 2% solids owf do not appreciably improve the oil and water repellency. Generally, when the polyamide material is nylon fiber, smaller denier fiber requires larger amounts of the fluorochemical composition than larger denier fiber.

The sulfonated novolak resin and water-soluble divalent metal salt can be applied from an aqueous exhaust bath such as is used in beck dyeing of carpet. The sulfonated novolak resin and the water soluble divalent metal salt can be added to the aqueous dye bath solution and exhausted concurrently with the dye. Generally, the dye bath is maintained at a temperature at or near the boiling point for a period of 10 to 90 minutes or more to effect exhaustion of the dye and the sulfonated novolak resin. Surprisingly, the dye bath can be maintained in the normal pH range of 4.5 to 8.0 with excellent results. Dye bath pH can range from 2.0 to 12.0, although pH in the range of 4 to 7 is preferred.

Alternatively, the sulfonated novolak resin and the water-soluble divalent metal salt can be added to the aqueous dye bath after exhaustion of the dye or the dyebath can be drained and fresh water added prior to the addition of the sulfonated novolak resin and the water-soluble divalent metal salt. Generally, the resin/salt bath is maintained at a temperature at or near boiling for a period of time sufficient to exhaust the resin, usually 10 to 90 minutes.

The sulfonated novolak resin and divalent metal salt can be applied during continuous dyeing, such as with Kuster TM or Otting TM carpet dyeing equipment. The sulfonated novolak resin and the water-soluble divalent metal salt can be added directly to the aqueous dye solution and the solution is conventionally applied to the polyamide carpet. Alternatively, the sulfonated novolak resin and the water-soluble metal salt can be applied during a wetting out step prior to application of the dye. The carpet is then steamed, as usual, for 3 to 5 minutes.

The sulfonated novolak resin and divalent salt can also be applied to polyamide material by a padding operation. This can be done as a separate step or in conjunction with the application of various convention finishes such as wetting agents, softeners, and leveling agents. After application of the resin/salt solution, the polyamide material is conventionally dried.

Fluorochemical compositions for providing oil and water repellency can also be applied in conjunction with the sulfonated novolak resin. The fluorochemical composition is simply added in an appropriate amount to the treating solution. In some cases, particularly in exhaust applications, useful divalent metal salts may be limited to the inorganic and organic magnesium salts.

The following non-limiting examples serve to illustrate the invention. In the following examples, all ratios are by weight and percentages are weight percent unless otherwise indicated. In the examples where the material being treated is nylon 66 carpet, the carpet is scoured, greige, unbacked, level-loop carpet.

Preparation of a sulfonated phenol-formaldehyde resin (hereinafter SPFR):

To a three-neck flask, fitted with a mechanical stirrer, thermometer, and condenser, was added 473 g of acetic anhydride and 945 g of 4,4'-dihydroxydiphenylsulfone (DDS). Then 473 g of conc. sulfuric acid was added via a dropping funnel over a period of one hour with stirring. The resulting reaction mixture was heated and stirred at 100° C. for 7 hours. Water (340 g) was added in portions while distilling off acetic acid over one hour. After addition of 250 g of 37% aqueous formaldehyde and 338 g of water, the reaction mixture was heated to 100° C. for 6 hours. The resulting sulfonated 4,4'-dihydroxydiphenylsulfone-formaldehyde condensate was diluted with 1400 g of water and neutralized to a pH of 6.0 with 550 g of 5% NaOH to yield the sodium salt of the partially sulfonated novolak resin product as a 36% aqueous concentrate (SPFR).

In the following examples, fibrous polyamide materials were evaluated using the following test methods:

Stain Resistance (SR)

A 1 g sample of the fibrous polyamide material under evaluation is placed in 40 ml aqueous solution containing 0.008 weight percent FD&C Red Dye No. 40 and 0.04 weight percent citric acid at room temperature (22° C.) and agitated for one hour. The sample is removed from the dye solution, rinsed and blotted with paper towels to remove excess moisture. The amount of staining is evaluated visually using a rating scale which ranges from 1–5, where 1 is essentially unstained and 5 is heavily stained. Generally, a stain resistance of less than 3 is satisfactory.

Water Repellency (WR)

The water repellency of treated polyamide samples is measured using a water/isopropyl alcohol test, and is expressed in terms of a water repellency rating on a scale of 0 to 10 of the treated carpet or fabric. Treated carpets which are penetrated by or resistant only to a 100 percent water/0 percent isopropyl alcohol mixture (the least penetrating of the test mixtures) are given a rating of 0, whereas treated fabrics resistant to a 0 percent water/100 percent isopropyl alcohol mixture (the most penetrating of the test mixtures) are given a rating of 10. Other intermediate values are determined by use of other water/isopropyl alcohol mixtures, in which the percentage amounts of water and isopropyl alcohol are each multiples of 10. The water repellency rating corresponds to the most penetrating mixture which does not penetrate or wet the fabric after 10 seconds contact. In general, a water repellency rating of at least 1, is desirable for carpet.

Oil Repellency (OR)

The oil repellency of the treated polyamide samples is measured by AATCC Standard Test 188-1978, which test is based on the resistance of treated fabric to penetration by oils of varying surface tensions. Treated fabrics resistant only to "Nujol". a brand of mineral oil and the least penetrating of the test oils, are given a rating of 1, whereas treated fabrics resistant to heptane (the most penetrating of the test oils) are given a value of 8. Other intermediate values are determined by use of other pure oils or mixtures of oils. The rated oil repellency corresponds to the most penetrating oil (or mixture of oils) which does not penetrate or wet the fabric after 10 seconds contact rather than the 30 seconds contact of the Standard Test. Higher numbers indicate better oil repellency. Additionally, a value of 0 indicates no resistance to "Nujol". In general, an oil repellency of at least 1 or greater is desirable for carpet.

Examples 1-3 and Comparative Example C1-C4

Samples of nylon 66 carpet which had been heat-set for 10 minutes at 150° C. under substantially dry conditions, were immersed in an aqueous bath containing 0.3% solids SPFR and the amount of various salts shown in Table 1. A 20:1 liquor to fabric ratio, a pH of 6 a bath temperature of 97° C., and a treatment time of 90 minutes were used. The carpet samples were removed from the bath, rinsed, and dried for 10 minutes at 70° C. and then for 5 minutes at 130° C. The carpet samples, together with a carpet sample to which no SPFR and no salt were added (Comparative Example C1), were tested for stain resistance (SR). The results are shown in Table 1.

TABLE 1

| Example | Salt Type | Salt amount (% owf) | SR |
|---|---|---|---|
| C1 | none | none | 5 |
| 1 | $MgCl_2$ | 1 | 1.5 |
| 2 | $MgSO_4$ | 1 | 1.5 |
| 3 | $Mg(OOCCH_3)_2$ | 1 | 1.5 |
| C2 | $(NH_4)_2SO_4$ | 1 | 4.5 |
| C3 | $(NH_4)_2SO_4$ | 5 | 3.0 |
| C4 | NaCl | 5 | 3.0 |

As can be seen from the data in Table 1, the use of divalent magnesium salts provides significantly better stain resistance to the carpet than does the use of the monovalent salts, ammonium sulfate and sodium chloride, even when relatively large amounts (5% owf) of the monovalent salts are used.

Examples 4-8 and Comparative Examples C5-C9

In Examples 4-7, samples of nylon 66 carpet which had been heat-set for 10 minutes at 150° C. under substantially dry conditions, were immersed for 90 minutes in an aqueous solution at 97° C. and a pH of 6 and a liquor to fabric ratio of 20:1 using 0.2% owf SPFR with 2% solids owf of various salts. In Comparative Example C5, no SPFR or salt were used and, in Comparative Example C6, SPFR was used without salt. In Example 8 and Comparative Examples C7-C9, 0.25% owf of a fluorochemical oil and water repellent composition, FX-364, available from 3M Company, was added to the treating solution containing SPFR and salt. Each sample was removed from the solution, rinsed, and dried for 10 minutes at 70° C. and then for 5 minutes at 130° C. Each sample was tested for stain resistance (SR), oil repellency (OR), and water repellency (WR). The results are shown in Table 2.

TABLE 2

| Example | SPFR | Salt | FC | SR | OR[c] | WR[c] |
|---|---|---|---|---|---|---|
| C5 | —[a] | — | — | 5 | F | F |
| C6 | x[b] | — | — | 4.5-5 | F | F |
| 4 | x | $MgCl_2$ | — | 1.5 | F | F |
| 5 | x | $BaCl_2$ | — | 1.5-2 | F | F |
| 6 | x | $CaCl_2$ | — | 1.5-2 | F | F |
| 7 | x | $ZnCl_2$ | — | 1.5-2 | F | F |
| 8 | x | $MgCl_2$ | x | 1.5 | 4 | 4 |
| C7 | x | $BaCl_2$ | x | 5 | F | 0 |
| C8 | x | $CaCl_2$ | x | 4.5-5 | 4 | 3 |
| C9 | x | $ZnCl_2$ | x | 4 | 5 | 4 |

[a]a dash indicates the constituent is not present
[b]"x" indicates the constituent is present
[c]"F" means the sample fails test, i.e., worse than 0

As can be seen from the results in Table 2, each of the samples treated with SPFR have good stain resistance when used with the indicated divalent metal salts although very little stain resistance resulted from the SPFR alone at this concentration. When the fluorochemical was added, oil and water repellency were achieved when $MgCl_2$, $CaCl_2$, and $ZnCl_2$ were present and adequate stain resistance was achieved only with $MgCl_2$ (Example 8).

Examples 9-10 and Comparative Examples C10-C11

Samples of nylon carpet which had been heat-set for 10 minutes at 150° C. under substantially dry conditions, were dyed by immersion in an aqueous bath using 0.25% owf Tectilon Blue 5GS, available from Ciba-Geigy Corp., without SPFR, with 0.15% solids owf SPFR only added, and with 0.15% solids owf SPFR and 2% owf $MgCl_2$ added. In Comparative Example C6 only water was used. In each, a liquor to fabric ratio of 20:1, a bath temperature of 97° C., a pH of 6 and a treatment time of 90 minutes were used. The dye exhausted well in each example to provide a level blue shade. Each sample was removed from the bath, rinsed, and dried for 10 minutes at 70° C. and then 5 minutes at 130° C. Each sample was evaluated for stain resistance (SR). The aqueous dye bath constituents and stain resistance are shown in Table 3.

TABLE 3

| Example | Dye | SPFR | $MgCl_2$ | SR |
|---|---|---|---|---|
| C6 | — | — | — | 5 |
| C7 | x | — | — | 5.0 |
| 9 | x | x | — | 3.0 |
| 10 | x | x | x | 1.0 |

As can be seen in Table 3, only when both the SPFR and $MgCl_2$ were present was excellent stain resistance achieved at this concentration of SPFR.

Examples 11 and 12 and Comparative Examples C12-C16

Samples of wool gabardine fabric were immersed in an aqueous solution of SPFR and 2.0% owf magnesium acetate as set forth in Table 4. For each sample, a liquor to fabric ratio of 20:1, treatment temperature of 97° C., a pH of about 6 and a treatment time of 90 minutes were used. Each sample was removed from the treating solution, rinsed, and dried for 10 minutes at 70° C. and then for 5 minutes at 130° C. Each sample was tested for stain resistance (SR). The results are shown in Table 4.

TABLE 4

| Example | SPFR | $Mg(OOCCH_3)_2$ | SR |
|---|---|---|---|
| C12 | — | — | 5 |
| C13 | 0.15 | — | 5 |
| C14 | 0.15 | x | 3 |
| C15 | 0.30 | — | 5 |
| 11 | 0.30 | x | 2 |
| C16 | 0.50 | — | 5 |
| 12 | 0.50 | x | 1.5 |

As can be seen from the results in Table 4, good stain resistance is achieved on wool gabardine at SPFR concentration of 0.30% owf and above when magnesium acetate was present. No stain resistance was shown when the salt was not used.

Examples 13–14 and Comparative Examples C17–C18

Samples of chamois (natural leather) and upholstery-weight, nylon Ultrasuede TM (synthetic leather) were treated by immersing the sample in water or in aqueous solutions containing 0.35% solids owf SPFR and 2% owf magnesium acetate at room temperature at a liquor to fabric ratio of 20:1 for 46 hours. Each sample was removed from the treating solution, rinsed and dried for 10 minutes at 70° C. and then for 5 minutes at 130° C. Each sample was tested for stain resistance (SR), the results are set forth in Table 5.

TABLE 5

| Example | Material | SPFR | $Mg(OOCCH_3)_2$ | SR |
|---|---|---|---|---|
| C17 | chamois | — | — | 5 |
| 13 | chamois | x | x | 1 |
| C18 | Ultrasuede TM | — | — | 4 |
| 14 | Ultrasuede TM | x | x | 1 |

As can be seen from the data in Table 5, excellent stain resistance can be achieved with both natural and synthetic leather when both SPFR and salt are present in the treatment bath.

Examples 15–24 and Comparative Examples C18–C29

Samples of nylon 66 level loop carpet which had been heat-set for 10 minutes at 150° C. under substantially dry conditions, were dyed by immersing the samples in aqueous solutions at various pH's using 0.35% solids owf SPFR with and without 2% owf magnesium acetate at a liquor to fabric ratio of 20:1, a treatment temperature of 97° C., a pH of about 6 and a treatment time of 90 minutes in a Launderometer. A sample also was treated with water only. Each sample was removed from the treating solution, rinsed, and dried for 10 minutes at 70° C. and then for 5 minutes at 130° C. Each sample was a tested for stain resistance (SR). The results are shown in Table 6.

TABLE 6

| Example | pH[a] | SPFR | Salt | SR |
|---|---|---|---|---|
| C19 | | — | — | 5 |
| C20 | 3 | x | — | 1.5 |
| 15 | 3 | x | x | 1 |
| C21 | 4 | x | — | 1.5 |
| 16 | 4 | x | x | 1 |
| C22 | 5 | x | — | 2.0 |
| 17 | 5 | x | x | 1–1.5 |
| C23 | 6 | x | — | 2.5 |
| 18 | 6 | x | x | 1.5–2 |
| C24 | 7 | x | — | 4.5 |
| 19 | 7 | x | x | 1.5 |
| C25 | 8 | x | — | 5.0 |
| 20 | 8 | x | x | 1.5–2 |
| C26 | 9 | x | — | 5.0 |

TABLE 6-continued

| Example | pH[a] | SPFR | Salt | SR |
|---|---|---|---|---|
| 21 | 9 | x | x | 2.5 |
| C27 | 10 | x | — | 5.0 |
| 22 | 10 | x | x | 2.5–3 |
| C28 | 11 | x | — | 5.0 |
| 23 | 11 | x | x | 3–3.5 |
| C29 | 12 | x | — | 5.0 |
| 24 | 12 | x | x | 3 |

[a]Adjusted with acetic acid or sodium hydroxide solution as required to achieve the desired pH.

The data in Table 6 show that the good stain resistance obtained with SPFR at pH values of 3–6 is improved by the addition of magnesium acetate. At pH values of 7–10, the poor stain resistance seen with the use of only SPFR is improved to acceptable stain resistance ratings with the addition of magnesium acetate.

Examples 25–27 and Comparative Examples C30–C32

In these Examples nylon upholstery fabric which had been heat-set for 10 minutes at 150° C. under substantially dry conditions, was treated by padding (50% wet pick up) an aqueous solution containing 0.3% solids owf SPFR with and without 2% owf magnesium chloride salt, and with and without a 0.3% solids owf of a blend of fluorochemical oil and water repellent composition, FC-214, available from 3M Company (FC). Each sample was dried for 10 minutes at 70° C. and then for 5 minutes at 130° C. Each sample was tested for stain resistance (SR), oil repellency (OR), and water repellency (WR). The results are shown in Table 7.

TABLE 7

| Example | SPFR | $MgCl_2$ | FC | SR | OR | WR |
|---|---|---|---|---|---|---|
| C30 | — | — | — | 5 | F | F |
| C31 | x | — | — | 1.5 | F | F |
| 25 | x | — | x | 1.5 | 4 | 3 |
| 26 | x | x | — | 1.5 | F | F |
| 27 | x | x | x | 1–1.5 | 2 | 1 |
| C32 | — | x | x | 5 | 5 | 8 |

As can be seen from the data in Table 7, when the magnesium chloride salt was present with the SPFR and the fluorochemical composition, acceptable oil and water repellency (rating of at least 1) and improved stain resistance (rating of 1–1.5) where achieved.

Examples 28–42 and Comparative Examples C33–C48

In these examples, samples of nylon 66 level loop carpet which had been heat-set under substantially dry conditions for 1 minute at 200° C., were treated by immersion in an aqueous bath at a liquor to fabric ratio of 21.5:1, at treating temperature of 97° C., and a treatment time of 90 minutes with 0.3% solids owf SPFR various commercial novolak resins (NR) with and without 2% owf magnesium chloride and with and without 0.25% solids owf of a fluorochemical composition, FX-364, available from 3M Company (FC). The pH was adjusted to 3.5 with acetic acid. The samples were removed from the treating solution, rinsed, and dried for 10 minutes at 70° C. and then for 5 minutes at 130° C. The samples were tested for stain resistance (SR), oil repellency (OR), and water repellency (WR). The results are shown in Table 8.

TABLE 8

| Example | NR[a] | Salt | FC | SR | OR[b] | WR[b] |
|---|---|---|---|---|---|---|
| C33 | — | — | — | 5 | nt | nt |

TABLE 8-continued

| Example | NR[a] | Salt | FC | SR | OR[b] | WR[b] |
|---|---|---|---|---|---|---|
| C34 | A | — | — | 1.5 | nt | nt |
| 28 | A | — | — | 1.5 | nt | nt |
| C35 | B | — | — | 2–2.5 | nt | nt |
| 29 | B | x | — | 1 | nt | nt |
| C36 | B | — | x | 2 | F | 1 |
| 30 | B | x | x | 2.5 | 4 | 7 |
| C37 | C | — | — | 1.5–2 | nt | nt |
| 31 | C | x | — | 1 | nt | nt |
| C38 | C | — | x | 1.5 | F | O |
| 32 | C | x | x | 1 | 3 | 6 |
| C39 | D | — | — | 1–1.5 | nt | nt |
| 33 | D | x | — | 1 | nt | nt |
| C40 | D | — | x | 1.5 | F | O |
| 34 | D | x | x | 1 | 4 | 6 |
| C41 | E | — | — | 1.5 | nt | nt |
| 35 | E | x | — | 1–1.5 | nt | nt |
| C42 | E | — | x | 1.5 | F | O |
| 36 | E | x | x | 1–1.5 | F | O |
| C43 | F | — | — | 2 | nt | nt |
| 37 | F | x | — | 1 | nt | nt |
| C44 | F | — | x | 2–2.5 | F | 1 |
| 38 | F | x | x | 1 | 3 | 6 |
| C45 | G | — | — | 1 | nt | nt |
| 39 | G | x | — | 1 | nt | nt |
| C46 | G | — | x | 1 | F | 2 |
| 40 | G | x | x | 1 | 4 | 6 |
| C47 | H | — | — | 2.5 | nt | nt |
| 41 | H | — | x | 1 | nt | nt |
| C48 | H | — | x | 2.5–3 | F | 2 |
| 42 | H | x | x | 1 | 3 | 6 |

[a]Novolak resin:
(A) SPFR
(B) MESITOL TM NBS
(C) INTRATEX TM N
(D) ERIONAL TM PA
(E) RESIST #4
(F) SYNTHABOND TM 1938
(G) AMERIOLATE TM
(H) NYLOFIXAN TM P
[b]"nt" indicates the sample was not tested Examples 43–48 and Comparative Examples C49–C51

Samples of nylon 66 level loop carpet which had been heat-set under substantially dry conditions for 10 minutes at 150° C., were treated by immersion in an aqueous solution containing 0.5% solids owf SPFR, with and without 20% owf magnesium sulfate salt, with and without 0.5% solids owf fluorochemical oil and water repellent (FC), and with and without Tectilon Blue 5GS dye, available from Ciba-Geigy Corp., as indicated in Table 9. Treatment was carried out at pH of 4.5, a liquor to fabric ratio of 20:1, a treatment temperature of 97° C., and a treatment time of 90 minutes. Comparative Example C49 was prepared using no SPFR, salt, fluorochemical, or dye. Each sample was removed from the treating solution, rinsed and dried at 70° C. for 10 minutes then at 130° C. for 5 minutes. Each sample was tested for stain resistance (SR), oil repellency (OR) and water repellency (WR). The results are shown in Table 9.

TABLE 9

| Example | Salt | FC[a] | Dye conc. (% owf) | SR | OR | WR |
|---|---|---|---|---|---|---|
| C49 | — | — | — | 5 | F | O |
| 43 | x | 1 | — | 1 | 6 | 8 |
| 44 | x | 2 | — | 1 | 5 | 6 |
| 45 | x | 1 | 0.5 | 1 | 6 | 9 |
| 46 | x | 2 | 0.5 | 1 | 5 | 7 |
| 47 | x | 1 | 4 | 1 | 5 | 8 |
| 48 | x | 2 | 4 | 1 | 5 | 5 |
| C50 | — | 1 | 4 | 1 | F | O |

TABLE 9-continued

| Example | Salt | FC[a] | Dye conc. (% owf) | SR | OR | WR |
|---|---|---|---|---|---|---|
| C51 | — | 2 | 4 | 1 | F | O |

[a]fluorochemical 1 is FC-232, a cationic fluorochemical composition available from 3M Company, fluorochemical 2 is FX-364, an anionic fluorochemical composition available from 3M Company.

As can be seen from Table 9, excellent stain resistance and oil and water repellency are achieved only when the salt is present as in Examples 43–48. Each dyed sample was levelly dyed to the expected depth based on the amount of dye present.

Example 49 and Comparative Examples C52–C53

Samples of nylon 66 level loop carpet which had been heat-set under substantially dry conditions for 1 minute at 200° C., were laboratory dyed using a procedure which simulates continuous carpet dyeing. Dye formulations containing 0.5 g/l Karawet TM DOSS, available from Lyndal Chemical Co., 0.25 g/l Sequesterent TM 220, available from Ciba-Geigy Corp., 0.1 g/l sodium thiosulfate, 0.026 g/l Tectilon TM Blue 4R200, 0.032 g/l Tectilon TM Red 2B200, and 0.050 g/l Tectilon TM Orange 3G200, each dye available from Ciba-Geigy Corp., with and without 0.35% solids owf SPFR and with and without 2% owf magnesium chloride were applied to the samples by pressing the samples face down in a tray containing the dye solution after the samples were wet-out with a 2 g/l aqueous solution of Karawet TM DOSS. The dye bath pH was 6.0. The carpet was removed from the dye bath and steamed at 100° C., 100% r.h. for 5 minutes, dried for 20 minutes at 70° C. and set at 130° C. for 10 minutes. The samples were tested for stain resistance. The results are shown in Table 10.

TABLE 10

| Example | SFPR | Salt | SR |
|---|---|---|---|
| C52 | — | — | 5 |
| C53 | x | — | 4.5 |
| 49 | x | x | 1 |

The results in Table 10 show that only when the salt is present, is excellent stain resistance achieved.

Various modifications and alterations of this invention will be apparent to those skilled in the art without departing from the scope and spirit of this invention and this invention should not be restricted to that set forth herein for illustrative purposes.

What is claimed is:

1. A method for providing fibrous polyamide materials with stain resistance comprising contacting the fibrous polyamide materials with an aqueous solution comprising a normally solid, water-soluble, partially sulfonated novolak resin, which comprises the condensation product of at least one phenolic compound and an aldehyde, and a water-soluble magnesium salt at a pH in the range of from 2 to 12.

2. The method of claim 1 comprising adding to a dyebath, before, during or after dyeing of the polyamide material, at least 0.1% solids based on the weight of the polyamide material of said sulfonated novolak weight of the least 1% based on the weight of the polyamide material of said water-soluble magnesium salt, immersing the polyamide material in the dyebath for a time and temperature sufficient to exhaust the sulfonated novolak resin onto the polyamide material, removing the polyamide material from the dyebath and drying the polyamide material.

3. The method of claim 1 comprising applying to the polyamide material a solution comprising at least 0.1% solids based on the weight of the polyamide material of said sulfonated novolak resin and at least 1% of said water-soluble magnesium salt based on the weight of the polyamide material, steaming said polyamide material for a time sufficient to effect adherence of said sulfonated novolak resin to said polyamide material, and drying the polyamide material.

4. The method of claim 1 comprising padding a solution comprising at least 0.1% based on the weight of the polyamide material of said sulfonated novolak resin and 1% based on the weight of the polyamide material of said divalent metal salt onto the polyamide material and drying the polyamide material.

5. The method of claim 1 wherein said water-soluble, divalent metal salt is magnesium sulfate, magnesium chloride, or magnesium acetate.

6. The method of claim 1 wherein said sulfonated novolak resin comprises a sulfonated condensation product of at least one phenolic compound and an aldehyde.

7. The method of claim 6 wherein said phenolic compound is a bis(hydroxyphenyl) sulfone and said aldehyde is formaldehyde or acetaldehyde.

8. The method of claim 1 wherein said aqueous solution further contains a fluorochemical oil and water repellent composition.

9. The method of claim 1 wherein said polyamide material is nylon, wool, silk, natural leather, or synthetic leather.

10. The method of claim 1 wherein said polyamide material is nylon 6 or nylon 66 carpet yarn.

11. A fibrous polyamide material treated according to the method of claim 1.

12. The fibrous polyamide material of claim 11 wherein said material has a stain resistance of less than 3.

13. A fibrous polyamide material treated according to the method of claim 8.

14. The fibrous polyamide material of claim 13 wherein said material has a stain resistance of less than 3, a water repellency of at least 1, and an oil repellency of at least 1.

15. A carpet comprised of nylon 6 or nylon 66 yarn, said carpet being treated according to the method of claim 1.

16. The carpet of claim 15 wherein said carpet has a stain resistance of less than 3.

17. The carpet of claim 15 wherein said carpet has a stain resistance of 1.

18. A carpet comprised of nylon 6 or nylon 66 yarn, said carpet being treated according to the method of claim 8 wherein said carpet has a stain resistance of less than e, a water repellency of at least 1, and an oil repellency of at least 1.

19. The carpet of claim 18 wherein said stain resistance is 1.

* * * * *